US006050270A

United States Patent [19]

Tyshenko, Jr.

[11] Patent Number: 6,050,270

[45] Date of Patent: Apr. 18, 2000

[54] FINGERNAIL GROOMING DEVICE

[76] Inventor: John A. Tyshenko, Jr., 135 Main St., Lake Geneva, Wis. 53147

[21] Appl. No.: 09/225,056

[22] Filed: Jan. 4, 1999

[51] Int. Cl.[7] ..... A45D 29/18

[52] U.S. Cl. ..... 132/73.6; 15/34; 132/76.4

[58] Field of Search ..... 132/73.6, 75.6, 132/75.8; D8/61, 62, 70, 105; 81/57.11, 57.13, 57.14; 173/169, 170; 15/34, DIG. 1; 451/66, 71, 259, 294

[56] References Cited

U.S. PATENT DOCUMENTS

| | | | |
|---|---|---|---|
| D. 307,194 | 4/1990 | Chou | D28/58 |
| D. 310,160 | 8/1990 | Patel | D8/61 |
| D. 312,327 | 11/1990 | DeRosier | D28/58 |
| D. 314,068 | 1/1991 | Sulik | D28/58 |
| D. 339,214 | 9/1993 | Eckard | D28/58 |
| D. 347,087 | 5/1994 | Griffin | D28/58 |
| D. 404,626 | 1/1999 | Hall et al. | D8/61 |
| 1,860,629 | 5/1932 | Stevenson et al. | 132/75.8 |
| 1,893,561 | 1/1933 | O'Donnell | 132/73.6 |
| 2,597,525 | 5/1952 | Kessler | 132/75.8 |
| 2,880,737 | 4/1959 | Tone | 132/73.6 |
| 3,563,252 | 2/1971 | Spohr et al. | 132/73.6 |
| 3,916,921 | 11/1975 | Pesola | 132/73.6 |
| 4,137,926 | 2/1979 | Pao | 132/73.6 |
| 4,478,232 | 10/1984 | Yasuda | 132/73.6 |
| 4,643,207 | 2/1987 | Grahame | 132/75.8 |
| 5,235,716 | 8/1993 | Stella | 15/34 |
| 5,465,740 | 11/1995 | Kim | 132/73.6 |

FOREIGN PATENT DOCUMENTS

| | | | |
|---|---|---|---|
| 1245373 | 9/1960 | France | 132/73.6 |

*Primary Examiner*—Todd E. Manahan

*Attorney, Agent, or Firm*—John D. Gugliotta; Michael J. Corrigan

[57] ABSTRACT

Disclosed is a battery operated, rechargeable fingernail grooming device consisting of a small, palm-sized handle having a round rotating manicuring disc attached to the end thereof. Powered by an electric motor contained within the handle, the discs are designed to perform a variety of individual manicuring tasks including cleaning, filing, buffing and polishing. The motor rotates the discs at a variable high rate of speed, allowing the user to manicure his or her nails quickly and efficiently.

4 Claims, 7 Drawing Sheets

FINGERNAIL GROOMING DEVICE

BACKGROUND OF THE INVENTION

1. Field of the Invention

The present invention relates generally to personal grooming supplies, and more specifically to a cordless, re-chargeable motorized fingernail grooming device that performs a variety of fingernail grooming functions including filing, cleaning, buffing and polishing.

2. Description of the Related Art

Those who have manicured hands and fingernails, especially women, know all too well of the amount of time and effort spent in maintaining a well-manicured appearance. Even those who are not as scrupulous with respect to fingernail appearance practice a normal routine of cleaning, trimming, filing, buffing and polishing the nails. In particular, the act of cleaning, filing, buffing and polishing one's nails consumes a great deal of time and effort. Use of a conventional nail files and other manual grooming utensils is tedious, requiring that the user manually rub the abrasive edge of the instrument along the nail in an attempt to achieve a smooth, uniform appearance. Quite often, however, the desired result is difficult to achieve due to the tendency of the user to apply the file at varying pressures and speeds. Accordingly, there is a need for a means by which one can maintain manicured fingernails in a quick and easy manner, producing quality and uniform results. The development of the present invention fulfills this need.

A search of the prior art did not disclose any patents that read directly on the claims of the instant invention. However, several references to fingernail filing devices were discovered. These devices neither anticipate nor disclose any embodiment that would preclude the novelty and the utilitarian functionality of the features of the present invention.

The following patents describe the design and function of various electrically powered nail file apparatus that incorporate the use of an oscillating file blade to perform filing functions:

U.S. Pat. No. 5,465,740, issued in the name of Kim;

U.S. Pat. No. 3,916,921, issued in the name of Pesola;

U.S. Pat. No. 2,880,737, issued in the name of Tone et al.; and

U.S. Pat. No. Des. 339,214, issued in the name of Eckard.

The following patents describe the design and function of various electrically powered nail file apparatus that incorporate the use of a rotating sanding/filing wheel to perform filing functions:

U.S. Pat. No. 4,478,232, issued in the name of Yasuda;

U.S. Pat. No. Des. 347,087, issued in the name of Griffin; and

U.S. Pat. No. Des. 251,858, issued in the name of Jensen.

Other related patents include the following:

U.S. Pat. No. Des. 314,068, issued in the name of Sulik;

U.S. Pat. No. Des. 312,327, issued in the name of DeRosier; and

U.S. Pat. No. Des. 307,194, issued in the name of Chou.

While several features exhibited within these references may be incorporated into this invention, alone and in combination with other elements, the present invention is sufficiently different so as to make it distinguishable over the prior art.

SUMMARY OF THE INVENTION

The present invention is a battery operated, rechargeable fingernail grooming device that allows the user to manicure his or her fingernails in an efficient manner, producing uniform results. The device consists of a small, palm-sized handle that houses an electric motor, the shaft of which drives a spindle that protrudes from the end of the handle. The motor is powered by a rechargeable battery pack, also stored in the handle, that can be recharged simply by placing the handle in a recharging base that plugs into a conventional wall socket. A series of round, interchangeable manicuring discs are included and attach to the spindle. The discs are designed to perform a variety of individual manicuring tasks including cleaning, filing, buffing and polishing. The motor rotates the discs at a variable high rate of speed, allowing the user to manicure his or her nails quickly and efficiently. The fact that the user is not required to manually actuate the filing device produces uniform results.

It is therefore an object of the present invention to provide a fingernail grooming device that uses an electric motor to drive a variety of grooming discs.

It is another object of the present invention to provide a fingernail grooming device that is cordless, powered by a rechargeable battery pack.

It is another object of the present invention to provide a fingernail grooming device that can be used to clean, file, polish and buff one's fingernails.

It is another object of the present invention to provide a fingernail grooming device that utilizes a variable speed motor.

It is another object of the present invention to provide a fingernail grooming device that produces consistent, uniform results.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

20 Fingernail Grooming Device
21 Grooming Tool
22 Recharging Base
25 Handle
26 Manicuring Disc
27 Power Cord
30 Left Handle Half
31 Right Handle Half
32 Threaded Fasteners
33 Recharging Pads
35 Control Switch
40 Spindle
41 Rechargeable Batteries
42 Electric Motor
43 Insulated Wires
45 Battery Connector Pads
46 Battery Terminals
50 Output Shaft
51 Beveled Gears
52 Bearing
55 Positive Terminal
56 Negative Terminal
60 Cylindrical Base
61 Tool Receiving Cavity
63 Recharging Terminals
65 Fingernails
66 Hand

DESCRIPTION OF THE PREFERRED EMBODIMENTS

1. Detailed Description of the Figures

Figure 1:
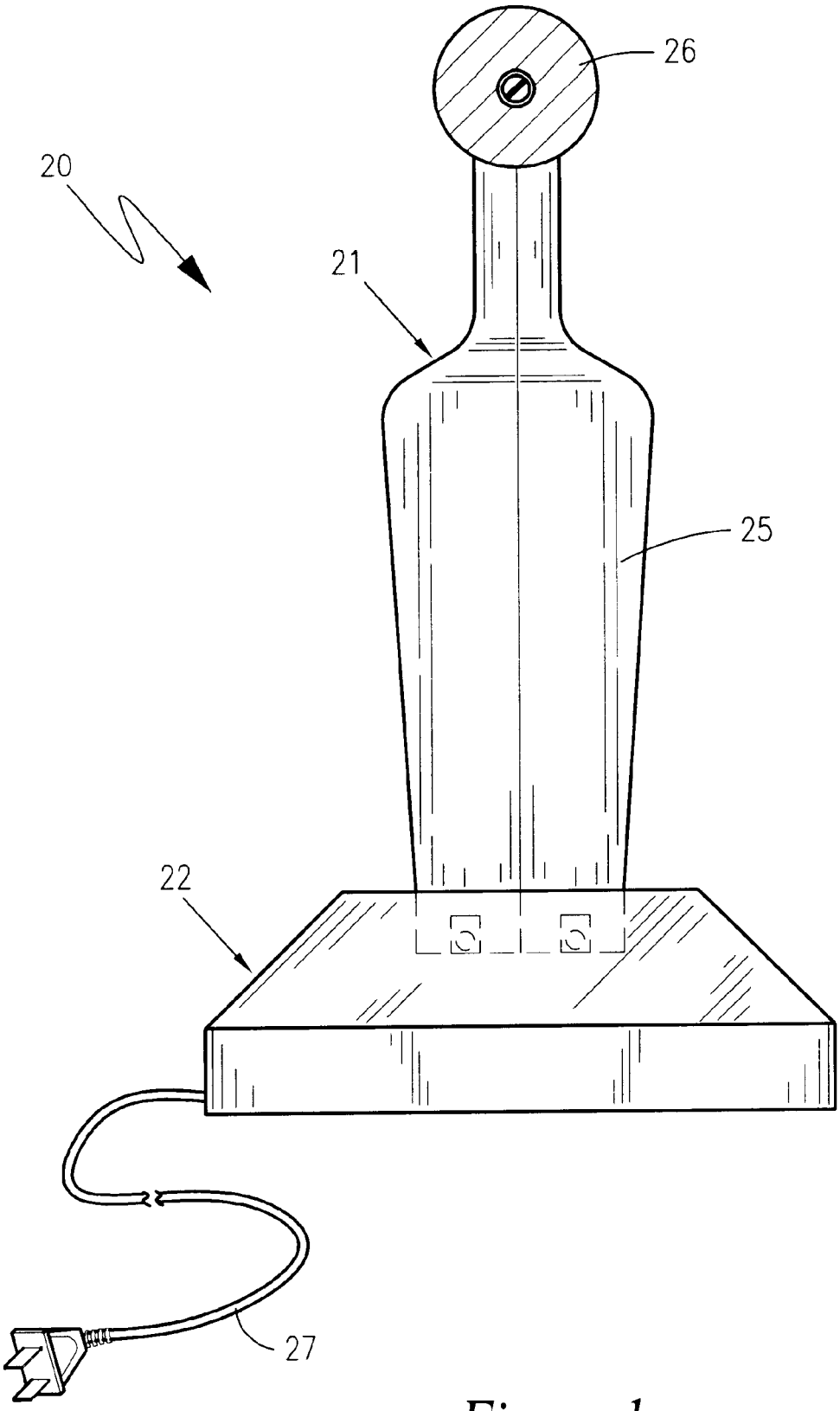
FIG. 1 is a front elevation view of the fingernail grooming device, according to the preferred embodiment of the present invention.
Figure 2:
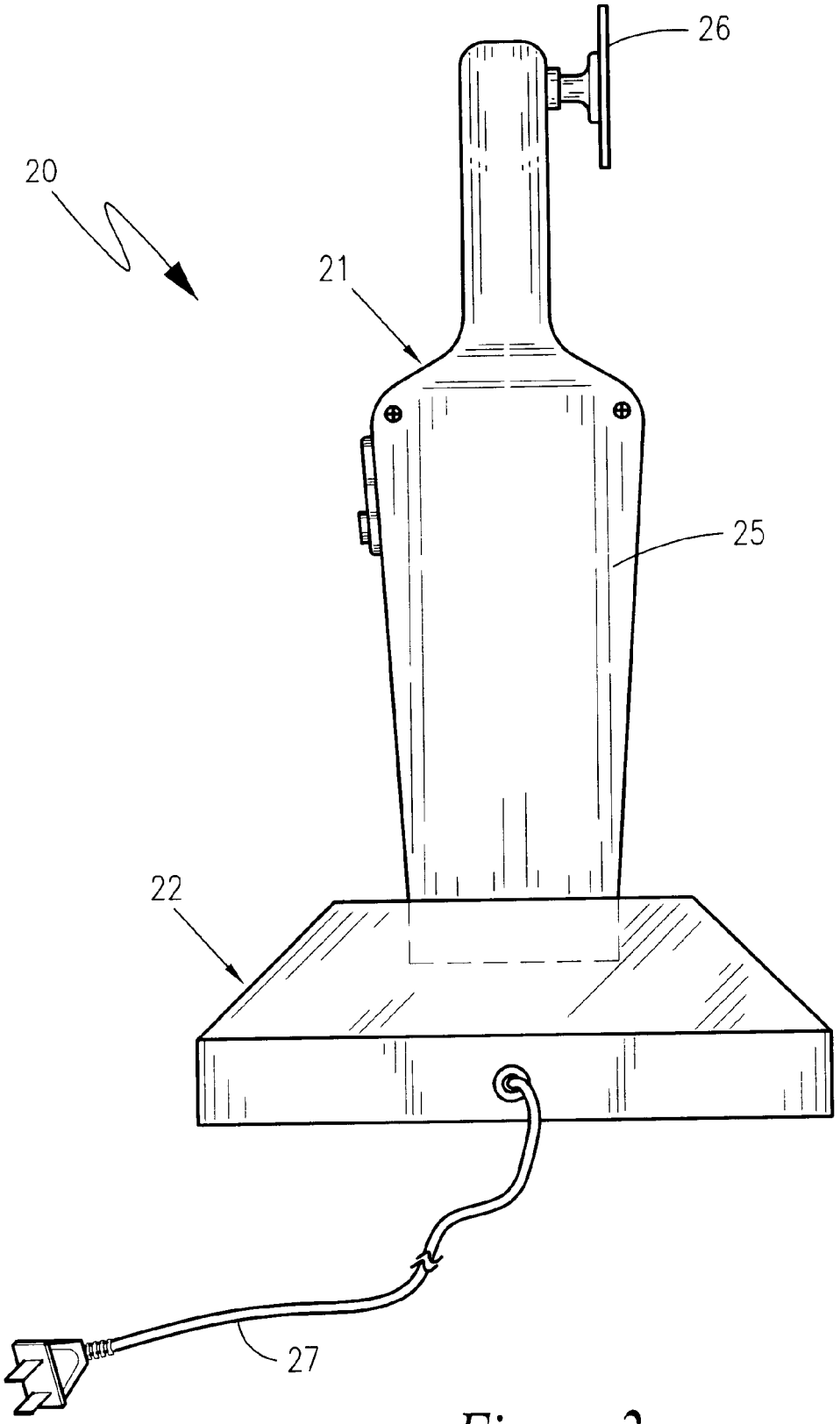
FIG. 2 is a side elevation view of the fingernail grooming device, according to the preferred embodiment of the present invention.
Figures 3, 4, 5:
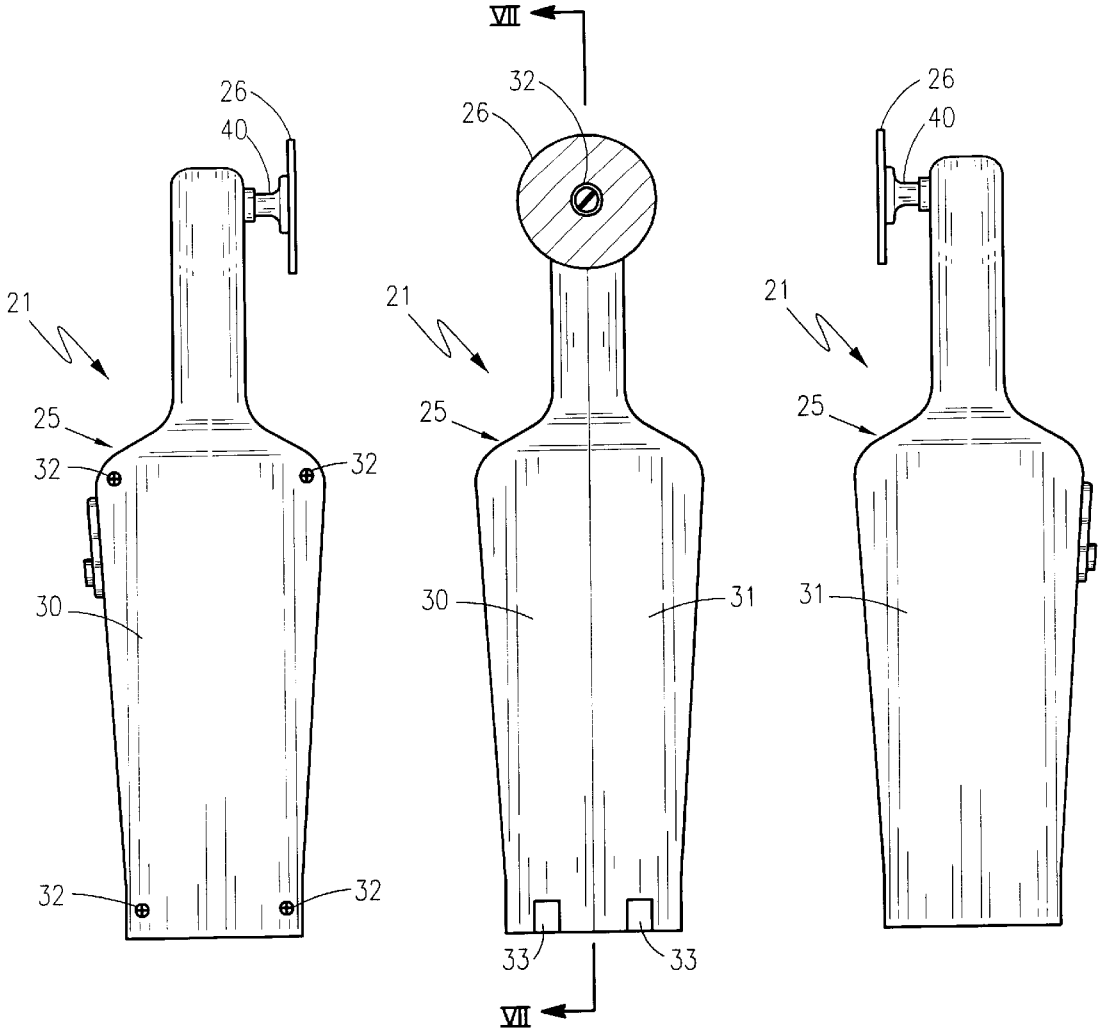
FIG. 3 is a front elevation view of the grooming tool portion of the fingernail grooming device, according to the preferred embodiment of the present invention.
FIG. 4 is a left side elevation view of the grooming tool portion of the fingernail grooming device, according to the preferred embodiment of the present invention.
FIG. 5 is a right side elevation view of the grooming tool portion of the fingernail grooming device, according to the preferred embodiment of the present invention.
Figure 6:
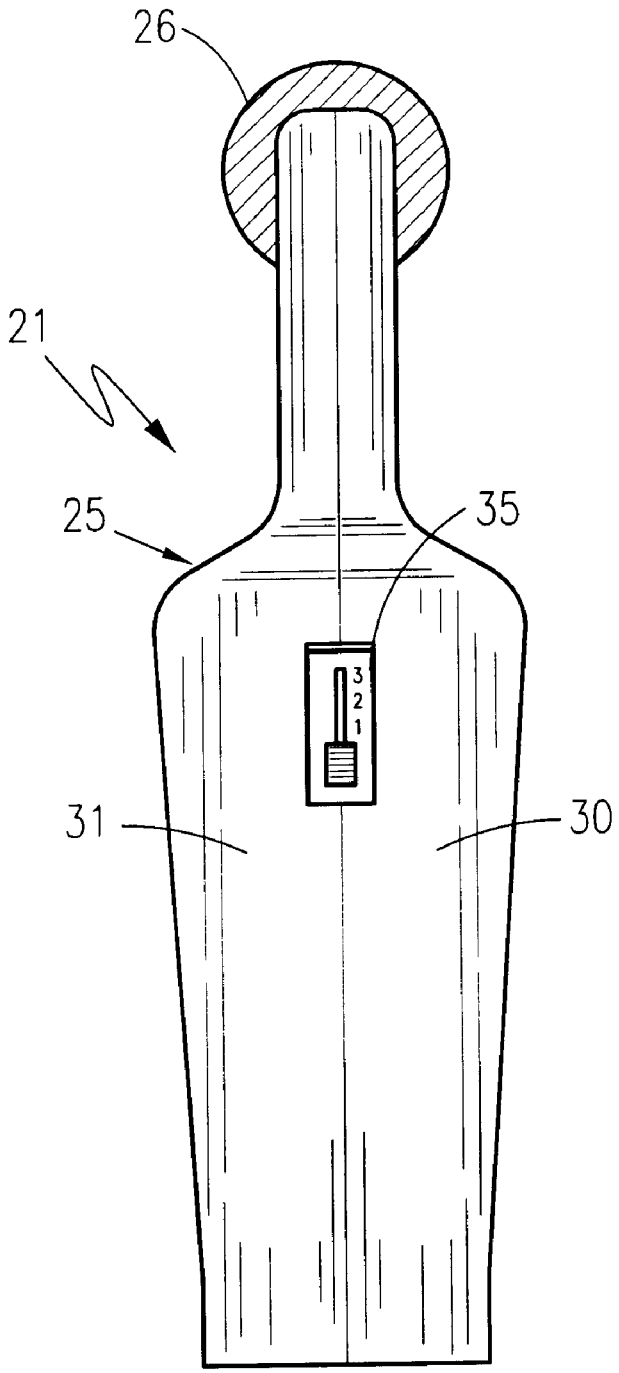
FIG. 6 is a rear elevation view of the grooming tool portion of the fingernail grooming device, according to the preferred embodiment of the present invention.

Referring now to FIGS. 1–2, depicted is the fingernail grooming device 20, according to the preferred embodiment of the present invention. The fingernail grooming device 20 consists of a grooming tool 21 and a recharging base 22. The grooming tool consists of an elongated handle 25 supporting a manicuring disc 26 that is driven by an electric motor powered by a rechargeable battery supply (not shown in FIGS. 1–2). The electric motor and battery supply are housed inside the handle 25. The recharging base 22 serves as a foundation upon which to store the grooming tool 21 and also serves to recharge the battery supply. As such, the recharging base 22 includes a power cord 27 that allows it to be plugged into a conventional wall socket.

Referring now to FIGS. 3–6, depicted is the grooming tool 21 portion of the fingernail grooming device 20, according to the preferred embodiment of the present invention. The handle 25 is of a two-piece molded plastic construction consisting of a left handle half 30 and a right handle half 31 connected by a series of threaded fasteners 32. It is realized, however, that alternate handle configurations and material constructions may be equally suitable and effective. The handle 25 is contoured so as to produce an ergonomic design that provides a comfortable fit/feel during use. A pair of recharging pads 33, located near the bottom of the handle 25, provide electrical connections for recharging the battery supply (not shown in FIGS. 3–5). A control switch 35 located on the handle 25 allows for powering up the grooming tool 21 and adjusting the rotational speed of the manicuring disc 26 between on of three speeds.

The manicuring discs 26 are attached to a spindle 40 via a threaded fastener 32. The spindle 40 is mechanically connected to the electric motor (not shown in FIGS. 3–6) and will be discussed in further detail herein below. The manicuring discs 26 perform a variety of functions, depending on the materials used in their construction. Sandpaper is used for filing functions, rigid cotton fibers are used for cleaning, and cotton/felt is used for buffing and polishing. The manicuring discs 26 are interchanged easily by removing the threaded fastener 32.

Figure 7:
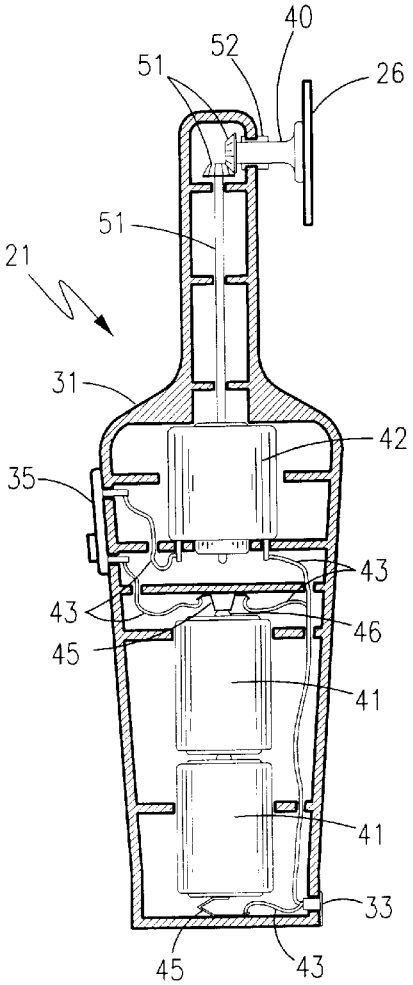
FIG. 7 is a left side sectional view of the grooming tool portion of the fingernail grooming device taken along line VII—VII in FIG. 3, according to the preferred embodiment of the present invention.

Referring now to FIG. 7, depicted is a left side sectional view of the grooming tool 21, according to the preferred embodiment of the present invention. In this Figure, the functional components of the grooming tool 21 are depicted seated within the right handle half 31. Rechargeable batteries 41 are electrically connected to an electric motor 42, control switch 35, and the recharging pads 33 by a series of insulated wires 43. The electrical circuit formed by these components will be discussed in further detail herein below. The electrical connection between the rechargeable batteries 41 and the insulated wires 43 is facilitated by battery connector pads 45 that lie in physical contact with the battery terminals 46.

The output shaft 50 of the electric motor 42 is mechanically connected to the spindle 40 by a pair of beveled gears 51. The beveled gears 51 translate the rotational axis of the output shaft 50 ninety degrees such that the spindle 40 and, thus, the manicuring pad 26 are spun by the electric motor 42. The spindle 40 is seated in a bearing 52 that facilitates a smooth and efficient operation.

Figure 8:
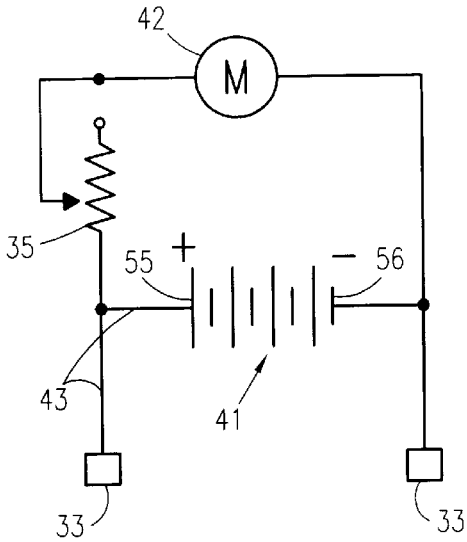
FIG. 8 is a schematic diagram of the circuitry incorporated into the grooming tool portion of the fingernail grooming device, according to the preferred embodiment of the present invention.

Referring now to FIG. 8, depicted is a schematic diagram of the circuitry incorporated into the grooming tool 21 portion of the fingernail grooming device 20, according to the preferred embodiment of the present invention. As shown in the figure, the rechargeable batteries 41 are connected in series with the control switch 35 and electric motor 42 by the insulated wires 43. Note that the control switch 35 is depicted as a variable resistance, rheostat device that allows for adjusting the voltage/current across the electric motor 42, thus varying the speed of the output shaft 50. Note also that a recharging pad 33 is connected to the positive terminal 55 and the negative terminal 56 of the rechargeable batteries 41. This connection allows for the recharging of the rechargeable batteries 41 when the grooming tool 21 is placed in the recharging base 22.

Figure 9:
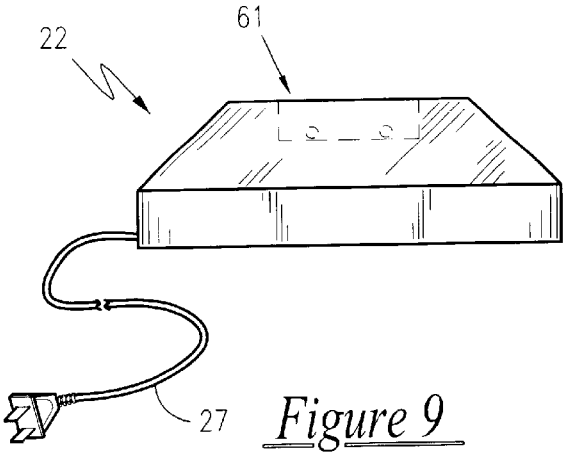
FIG. 9 is a front elevation view of the recharging base for use in conjunction with the fingernail grooming device, according to the preferred embodiment of the present invention.
Figure 10:
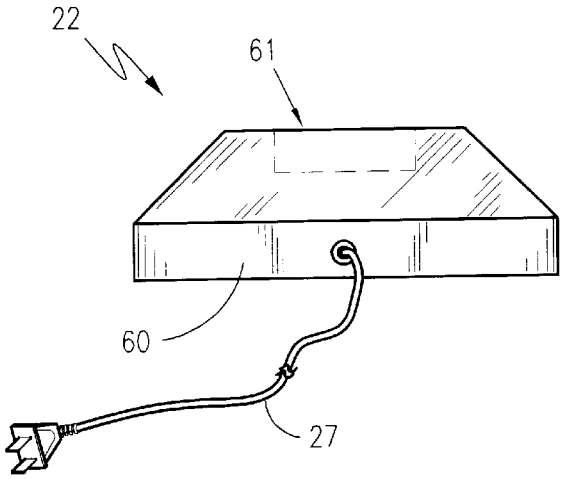
FIG. 10 is a left side elevation view of the recharging base for use in conjunction with the fingernail grooming device, according to the preferred embodiment of the present invention.
Figure 11:
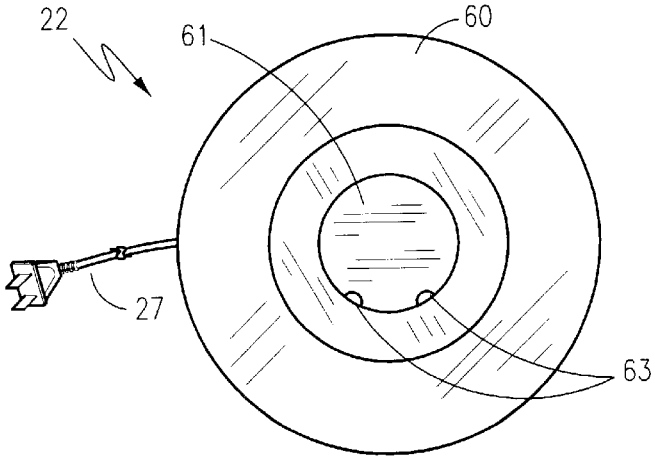
FIG. 11 is a top view of the recharging base for use in conjunction with the fingernail grooming device, according to the preferred embodiment of the present invention.

Referring now to FIGS. 9–11, depicted is the recharging base 22 for use in conjunction with the fingernail grooming device 20, according to the preferred embodiment of the present invention. The recharging base 22 consists of a tapered, cylindrical base 60 having a cylindrical tool receiving cavity 61 that receives the grooming tool 21, supporting it via a friction fit. The tool receiving cavity 61 has a pair of recharging terminals 63 that protrude therein, engaging with the recharging pads 33 when the grooming tool 21 is at rest in the recharging base 22. The recharging terminals 63 are connected electrically to a recharging device consisting of an inverter/transformer combination (not shown in the figures) that is supported within the recharging base. Connected to a conventional wall socket via the power cord 27, the recharging device supplies a charging current to the rechargeable batteries 41 in the grooming tool 21, thus ensuring that they will be fully charged and ready for use.

2. Operation of the Preferred Embodiment

Figure 12:
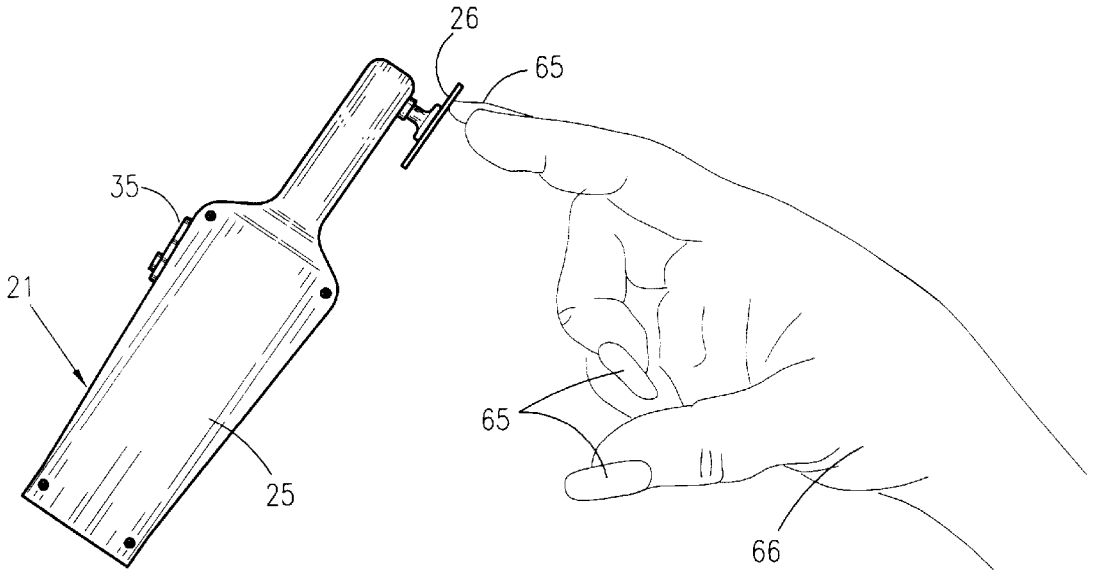
FIG. 12 is a perspective view of the fingernail grooming device depicting its use, according to the preferred embodiment of the present invention.

In accordance with the preferred embodiment of the present invention and as shown in FIG. 12, the fingernail grooming device 20 is used in the following manner. The user first selects the proper manicuring disc 26 for the desired operation, i.e. sanding, cleaning, buffing or polishing, and attaches it to the spindle 40 via the threaded fastener 32. The user then selects the desired speed setting via the control switch 35, thus starting the electric motor 42 and the rotation of the manicuring disc 26. The user then uses the grooming tool 21 to perform the manicuring operation by bringing the fingernails 65 of each hand 66 into contact with the rotating manicuring disc 26, one at a time until the desired appearance is achieved. The sanding discs are used essentially to file the tips of the fingernails 65 whereas the cleaning, buffing and polishing discs can be used on the edges of the fingernails 65 as well as the surface thereof.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A fingernail grooming device for filing, cleaning, polishing and buffing fingernails, said fingernail grooming device comprising:

a grooming tool comprising an elongated housing forming a handle end opposite a spindle end, said spindle end having a spindle rotatably secured thereto and protruding therefrom, said spindle having fastening means for detachably securing a manicuring disc thereto, said manicuring disc being one of a plurality of manicuring discs of varying textures and compositions, which are components of said fingernail grooming device, such that said manicuring disc rotates along with said spindle, said elongated housing supporting an electric motor, the operation of which causes rotational movement of said spindle, said electric motor being powered by a rechargeable battery supply supported in said elongated housing, said elongated housing having current receiving means on the surface of said handle end for receiving a recharging current that recharges said rechargeable battery supply;

at least one bearing, said bearings being of the ball type, and said ball bearings designed to allow said spindle to swivel;

a recharging base comprising a base housing having a tool receiving cavity that receives said handle end, supporting said grooming tool via friction fit, said base housing supporting recharging means that produce said recharging current when electrically connected to an external source of electricity, said tool receiving cavity having current supplying means for supplying said recharging current to said rechargeable battery supply via said current receiving means while said grooming tool is at rest within said recharging base; and a beveled gear arrangement, said beveled gear arrangement designed to translate the rotational force produced by the output shaft of said electric motor, causing said spindle to rotate therewith.

2. The fingernail grooming device of claim 1, wherein said grooming tool further comprises a variable speed control switch that allows the speed of said motor, and thus said spindle and said manicuring disc, to be adjusted.

3. The fingernail grooming device of claim 1, wherein said manicuring disc further comprises sandpaper, cotton and brush material constructions so as to allow for a variety of grooming/manicuring functions such as filing, cleaning, polishing and buffing.

4. The fingernail grooming device of claim 1, wherein said handle end is contoured so as to form an ergonomic design that provides a comfortable feel during use.

* * * * *